US010001004B2

(12) United States Patent
Bayliss et al.

(10) Patent No.: US 10,001,004 B2
(45) Date of Patent: Jun. 19, 2018

(54) CLOSED LOOP MODEL PREDICTIVE CONTROL OF DIRECTIONAL DRILLING ATTITUDE

(71) Applicant: Schlumberger Technology Corporation, Sugar land, TX (US)

(72) Inventors: Martin Thomas Bayliss, Stroud (GB); James Ferris Whidborne, Milton Keynes (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 331 days.

(21) Appl. No.: 14/172,895

(22) Filed: Feb. 4, 2014

(65) Prior Publication Data

US 2015/0218887 A1 Aug. 6, 2015

(51) Int. Cl.

| | |
|---|---|
| ***G01V 3/00*** | (2006.01) |
| ***E21B 47/00*** | (2012.01) |
| ***G01C 9/00*** | (2006.01) |
| ***E21B 44/00*** | (2006.01) |

(52) U.S. Cl.

CPC ..... *E21B 44/005* (2013.01)

(58) Field of Classification Search

CPC ..... E21B 44/00; E21B 47/024; E21B 7/04; E21B 7/06; E21B 44/02; G05B 15/02; G06F 19/00

USPC ..... 340/853.1–856.4; 166/66, 250.01, 255.2; 175/45; 703/7; 702/6, 9, 94–95, 702/150–154; 73/152.43–152.49, 152.01

See application file for complete search history.

(56) References Cited

U.S. PATENT DOCUMENTS

| | | | | |
|---|---|---|---|---|
| 9,022,141 | B2 * | 5/2015 | Panchal | E21B 7/04 175/24 |
| 2005/0269082 | A1 | 12/2005 | Baron et al. | |
| 2009/0000823 | A1 * | 1/2009 | Pirovolou | E21B 7/04 175/61 |
| 2009/0205867 | A1 | 8/2009 | Reckmann et al. | |
| 2013/0032401 | A1 | 2/2013 | Edbury et al. | |

(Continued)

FOREIGN PATENT DOCUMENTS

| | | | | |
|---|---|---|---|---|
| WO | WO2013016282 | * | 1/2013 | E21B 47/02 |

OTHER PUBLICATIONS

Panchal et al., Robust Linear Feedback Control of Attitude for Directional Drilling Tools., Aug. 2010, 13th IFAC Symposium on Automation in Mining, Mineral and Metal Processing.*

(Continued)

*Primary Examiner* — Firmin Backer
*Assistant Examiner* — Jerold Murphy

(57) ABSTRACT

A closed loop method for using model predictive control (MPC) to control direction drilling attitude includes receiving a demand attitude and a measured attitude. The received attitudes are processed using a closed loop MPC scheme to obtain an attitude error that may be further processed to obtain a corrective setting for a directional drilling tool. The corrective setting is then applied to alter the direction of drilling. The process of measuring the attitude, processing via the model predictive control scheme, and applying a corrective setting may be repeated continuously while drilling. The disclosed methodology is intended to provide for superior directional control during closed loop directional drilling operations.

16 Claims, 7 Drawing Sheets

(56) References Cited

U.S. PATENT DOCUMENTS

| | | | |
|---|---|---|---|
| 2013/0126239 | A1 | 5/2013 | Panchal et al. |
| 2013/0151157 | A1 | 6/2013 | Brooks et al. |
| 2013/0151158 | A1 | 6/2013 | Brooks et al. |
| 2013/0248247 | A1 | 9/2013 | Sugiura |

OTHER PUBLICATIONS

J.M. Maciejowski, "Predictive Control with Constraints", Prentice Hall, ISBN 978-0-2013-9823-6, p. 81.

Panchal et al, "Attitude Control System for Directional Drilling Bottom Hole Assemblies", IET Proceedings Control Theory and Applications, 6, 884-892, 2012.

C.R. Cutler and B.L. Ramaker, "Dynamic matrix control—a computer control algorithm. Proceedings", Joint American Control Conference, San Francisco 1980.

Kothare, Mayuresh, V., Balakrishnan, V., and Morari, M., "Robust constrained model predicitve control using linear matrix inequalities," Automatica, 32, 1361-1379, 1996.

Trimboli, S., Di Cairano, S., Bemporad, A., and Kolmanovsky, I.V., "Model predictive control with delay compensation for air-to-fuel ratio control," Time Delay Systems: Methods, Applications and New Trends: Lecture Notes in Control and Information Sciences, 423, 319-330, 2012.

International search report for the equivalent PCT patent application No. PCT/US2015/011936 issued on May 11, 2015.

International Preliminary Report on Patentability issued Aug. 9, 2016 in International application PCT/US2015/011936. 10 pages.

Panchal et al., Robust linear feedback control of attitude for directional drilling tools. Aug. 2-4, 2010, 13th IFAC Symposium on Automation in Mining, Mineral and Metal Processing, Cape Town, South Africa. pp. 92-97.

* cited by examiner

CLOSED LOOP MODEL PREDICTIVE CONTROL OF DIRECTIONAL DRILLING ATTITUDE

CROSS REFERENCE TO RELATED APPLICATIONS

None.

FIELD OF THE INVENTION

Disclosed embodiments relate generally to methods for maintaining directional control during downhole directional drilling operations and more particularly to closed loop model predictive control of direction drilling attitude.

BACKGROUND INFORMATION

The use of automated drilling methods is becoming increasingly common in drilling subterranean wellbores. Such methods may be employed, for example, to control the direction of drilling based on various downhole feedback measurements, such as inclination and azimuth measurements made while drilling or logging while drilling measurements.

One difficulty with automated drilling methods is that the feedback measurements are not generally made at the drill bit. It will be appreciated that there are severe space limitations very low in the bottom hole assembly (BHA) and that there are physical and operational constraints that limit how close the measurement sensors can be located to the drill bit. The sensors are therefore commonly located a significant distance above the bit such that the resulting sensor measurements are subject to a time delay related to the rate of penetration of the tool through the subterranean formation and the spatial offset between the bit and the sensors. In closed loop drilling operations, a temporal feedback delay can lead to drilling a spiraling borehole which tends to increase frictional forces between the drill string and the borehole wall. A spiraling borehole may further reduce the hole cleaning efficiency of the drilling fluid which in a worst case scenario can lead to the drill string becoming irretrievably stuck in the borehole.

Therefore there remains a need in the art for improved automated drilling methods and systems, particularly ones that can mitigate the effect of the aforementioned feedback delay and hence reduce or eliminate borehole spiraling. There is also a need for such methods and systems to compensate for drop and turn tendencies of the BHA while drilling.

SUMMARY

A closed loop method for using model predictive control (MPC) to control direction drilling attitude is disclosed. The control methodology includes receiving a demand attitude (e.g., demand inclination and azimuth values) as well as a measured attitude (e.g., measured inclination and azimuth values). The received values are processed using a closed loop MPC scheme to obtain an attitude error (e.g., inclination and azimuth errors) that may be further processed to obtain a corrective setting for a directional drilling tool (e.g., a steering tool). The corrective setting is then applied to alter the direction of drilling. The process of measuring the attitude, processing via the model predictive control scheme, and applying a corrective setting may be repeated continuously while drilling.

The disclosed embodiments may provide various technical advantages. For example, the disclosed embodiments provide superior directional control. In particular, the use of a feedback measurement delay compensated MPC scheme may substantially eliminate drilling attitude oscillations inherent in delay uncompensated schemes. Moreover the use of the closed loop MPC attitude tracking scheme may provide flexibility in bottom hole assembly (BHA) design, allowing the inclination and azimuth sensors to be moved further up the BHA (away from the bit) while at the same time achieving the aforementioned superior directional control. For example, logging while drilling (LWD) sensors may be deployed between the drill bit and measurement while drilling (MWD) sensors used to measure borehole inclination and azimuth. Such a configuration may be advantageous for geosteering applications as it enables the LWD sensors to be located closer to the bit.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
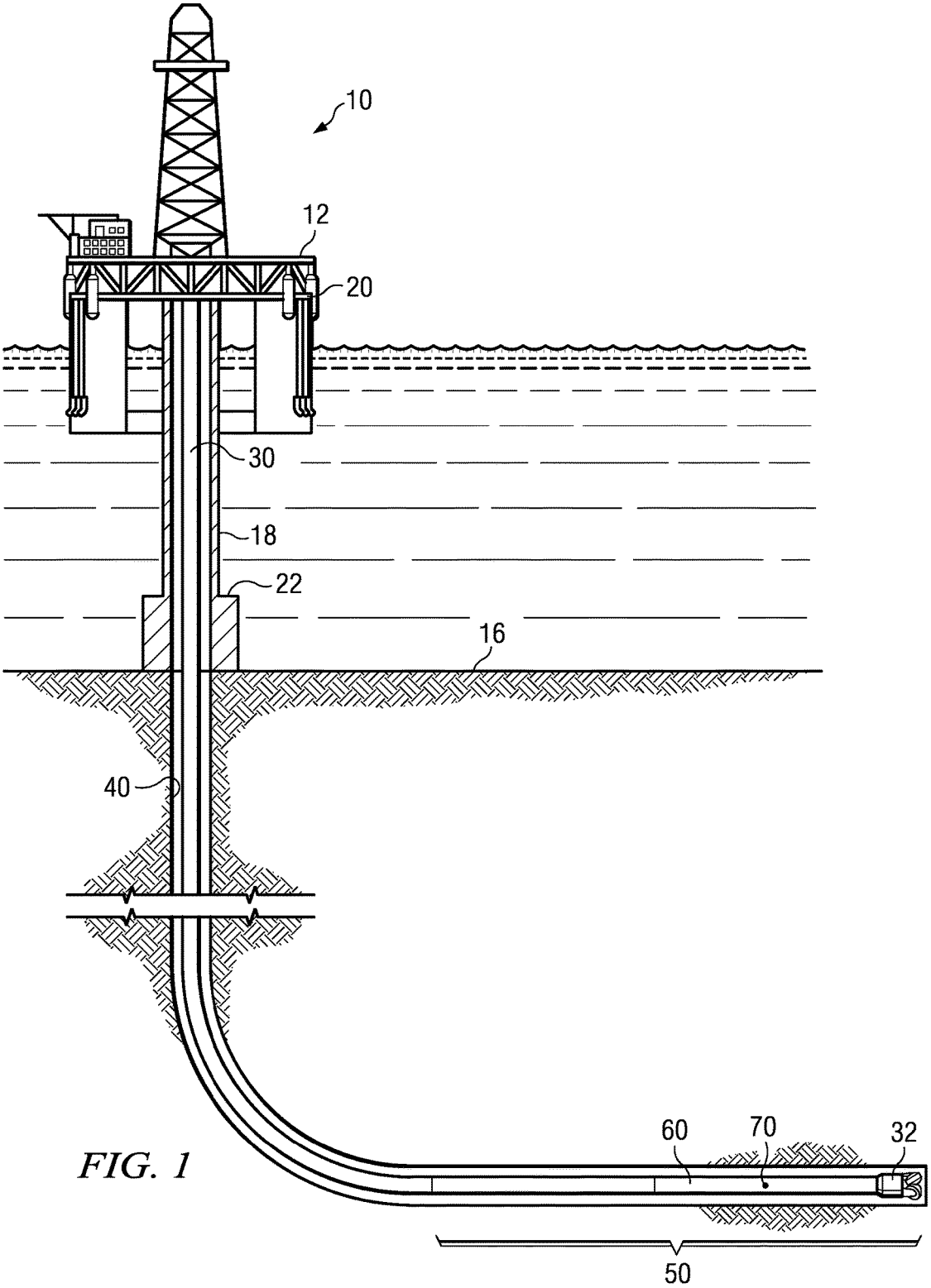
FIG. 1 depicts an example drilling rig on which disclosed embodiments may be utilized.

FIG. 1 depicts a drilling rig 10 suitable for using various method and system embodiments disclosed herein. A semi-submersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into borehole 40 and includes a bottom hole assembly (BHA) 50. The BHA 50 includes a drill bit 32, a steering tool 60 (also referred to as a directional drilling tool), and one or more downhole sensors 70 such as measurement while drilling sensors for measuring borehole inclination and borehole azimuth while drilling. The BHA 50 may further include substantially any other suitable downhole tools such as a downhole drilling motor, a downhole telemetry system, a reaming tool, and the like. The disclosed embodiments are not limited in these regards.

It will be understood that substantially any suitable steering tool 60 may be used in the disclosed method embodiments, for example, including a rotary steerable tool. Various rotary steerable tool configurations are known in the art. For example, the PathMaker® rotary steerable system (available from PathFinder® a Schlumberger Company), the AutoTrak® rotary steerable system (available from Baker Hughes), and the GeoPilot® rotary steerable system (available from Sperry Drilling Services) include a substantially non-rotating outer housing employing blades that engage the borehole wall. Engagement of the blades with the borehole wall is intended to eccenter the tool body, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the borehole wall.

The PowerDrive® rotary steerable systems (available from Schlumberger) fully rotate with the drill string (i.e., the outer housing rotates with the drill string). The PowerDrive® Xceed® makes use of an internal steering mechanism that does not require contact with the borehole wall and enables the tool body to fully rotate with the drill string. The PowerDrive® X5 and X6 rotary steerable systems make use of mud actuated blades (or pads) that contact the borehole wall. The extension of the blades (or pads) is rapidly and continually adjusted as the system rotates in the borehole. The PowerDrive® Archer® makes use of a lower steering section joined at a swivel with an upper section. The swivel is actively tilted via pistons so as to change the angle of the lower section with respect to the upper section and maintain a desired drilling direction as the bottom hole assembly rotates in the borehole. Accelerometer and magnetometer sets may rotate with the drill string or may alternatively be deployed in an internal roll-stabilized housing such that they remain substantially stationary (in a bias phase) or rotate slowly with respect to the borehole (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used for measuring borehole inclination and/or borehole azimuth. Such sensors may include, for example, accelerometers, magnetometers, gyroscopes, and the like. Such sensor arrangements are well known in the art. Methods for making real time while drilling measurements of the borehole inclination and borehole azimuth are disclosed, for example, in commonly assigned U.S. Patent Publications 2013/0151157 and 2013/0151158. The downhole sensors may further include logging while drilling sensors such as a natural gamma ray sensor, a neutron sensor, a density sensor, a resistivity sensor, an ultrasonic sensor, an audio-frequency acoustic sensor, and the like. The disclosed embodiments are not limited to the use of any particular sensor embodiments or configurations. In the depicted embodiment, the sensors 70 are shown to be deployed in the steering tool 60. Such a depiction is merely for convenience as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
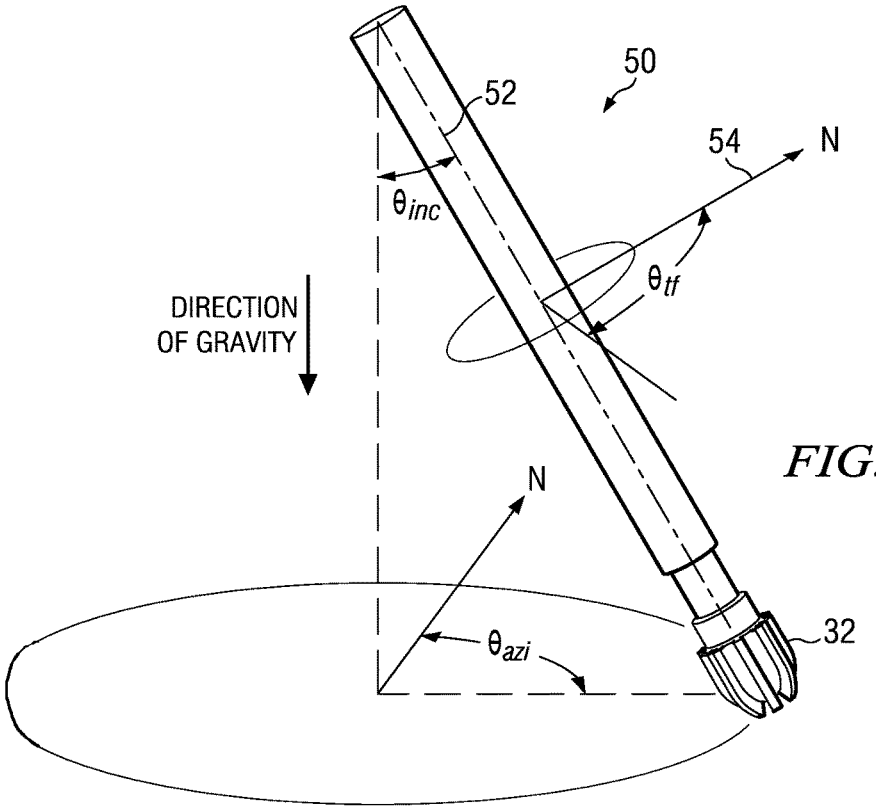
FIG. 2 depicts a diagram of attitude and steering parameters in a global coordinate reference frame.

FIG. 2 depicts a diagram of attitude and steering parameters in a global coordinate reference frame. The BHA 50 has an "attitude" defined by the BHA axis 52. The attitude is the direction of propagation of the drill bit 32 and may be represented by a unit vector, the direction of which can be defined by the borehole inclination $\theta_{inc}$ and the borehole azimuth $\theta_{azi}$. A tool face angle $\theta_{tf}$ of a sensor or other BHA component may be defined, for example, with respect to a high side of the BHA 54. The disclosed embodiments are in no way limited by the conventions illustrated in FIG. 2.

Figure 3:
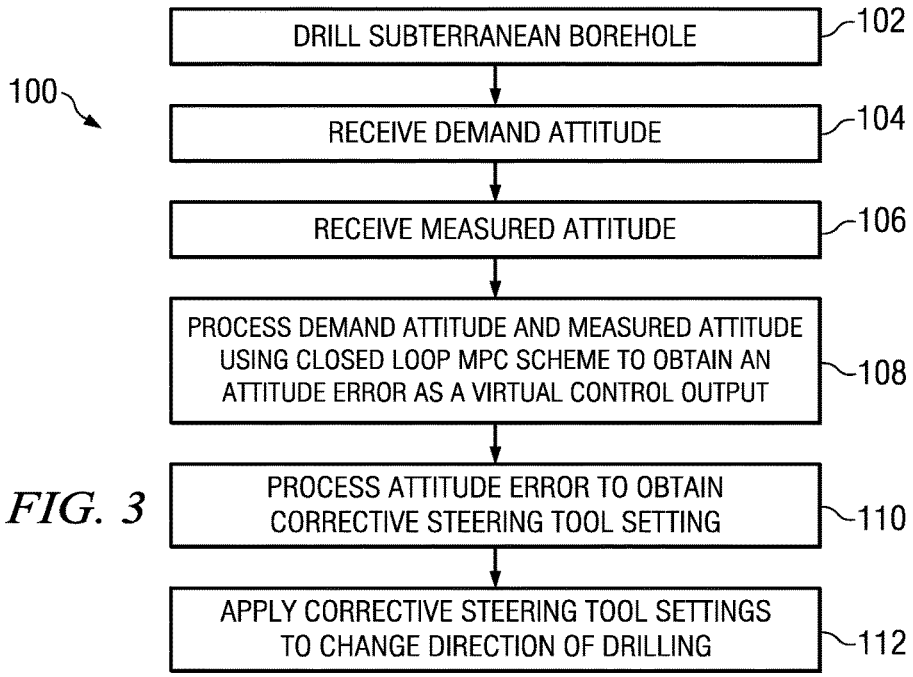
FIG. 3 depicts a flow chart of one closed loop method embodiment for controlling the direction of drilling a subterranean borehole.

FIG. 3 depicts a flow chart of one closed loop method embodiment 100 for controlling the direction of drilling a subterranean borehole. A subterranean borehole is drilled at 102, for example, via rotating a drill string, pumping drilling fluid through a downhole mud motor, or the like. A directional drilling tool (steering tool) may also be actuated so as to control the direction of drilling (the drilling attitude). A demand attitude is received at 104. This is the attitude at which the borehole is to be drilled. A measured attitude is received at 106. The measured attitude may include inclination and azimuth values measured using substantially any suitable downhole sensor arrangements, for example, including accelerometers, magnetometers, gyroscopic sensors, and the like.

At 108 the received demand attitude and the measured attitude are processed using a closed loop model predictive control (MPC) scheme. The MPC scheme may be augmented, for example, with first order feedback delay approximations to compensate for feedback delay between the real borehole inclination and borehole azimuth at the bit and those measured some distance above the bit. The MPC scheme outputs an attitude error which is in turn further processed at 110 to obtain one or more corrective steering tool settings. The attitude error may be understood to behave as a virtual control output from the MPC scheme and thus may also be referred to herein as a virtual control output (or outputs) or an error/virtual control output. The corrective steering tool setting(s) may be obtained via partially linearizing a transform and may be applied at 112 to change the drilling attitude (the direction of drilling) of the BHA. Steps 108, 110, and 112 may be continuously repeated to so as to maintain a drilling direction substantially equal to the demand attitude (inclination and azimuth) received at 106.

Figure 4:
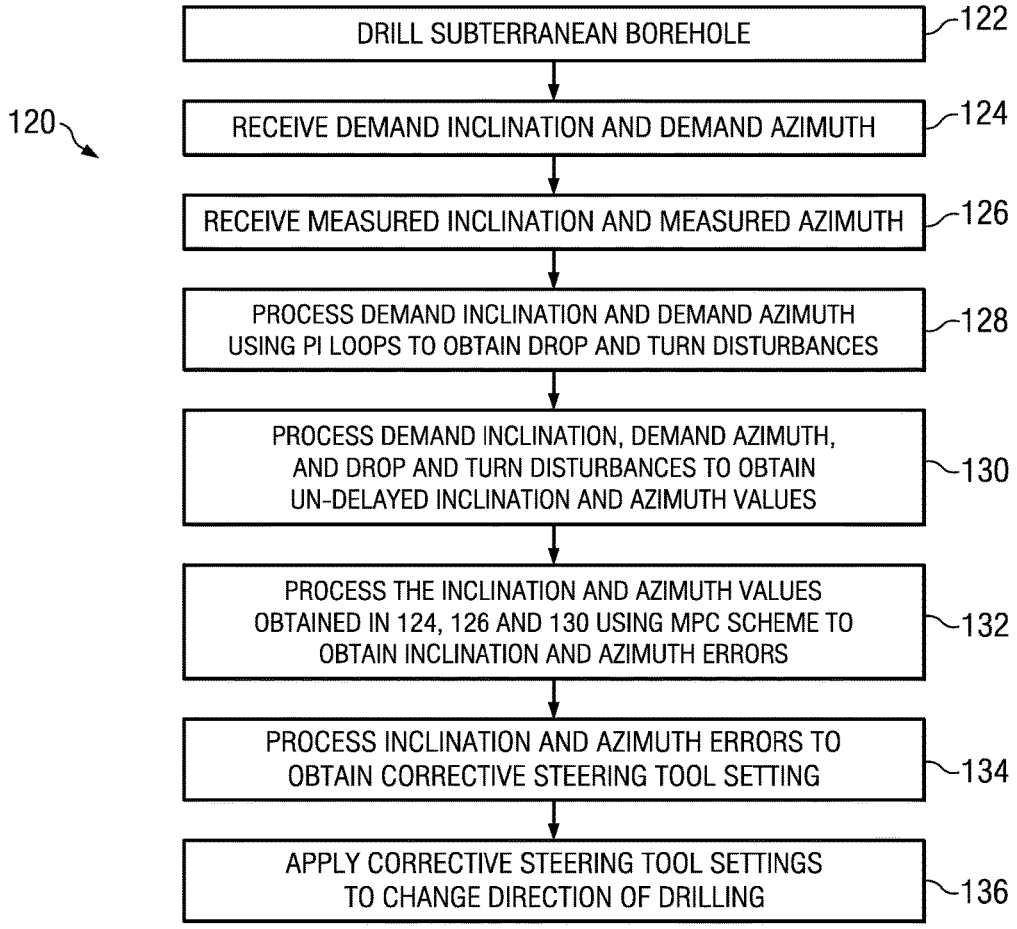
FIG. 4 depicts a flow chart of another closed loop method embodiment for controlling the direction of drilling a subterranean borehole.

FIG. 4 depicts a flow chart of another closed loop method embodiment 120 for controlling the direction of drilling a subterranean borehole. Method 120 is similar to method 100 in that it includes closed loop MPC control of the drilling attitude. A subterranean borehole is drilled at 122, for example, as described above. A demand inclination and a demand azimuth are received at 124. Measured borehole inclination and borehole azimuth values are received at 126. At 128 the received demand inclination and demand azimuth are processed via corresponding proportional integral (PI) loops to obtain corresponding drop and turn disturbances of the BHA. The drop and turn disturbances may be further processed in combination with the demand inclination and demand azimuth to obtain un-delayed borehole inclination and borehole azimuth values at 130. At 132 the received demand inclination and demand azimuth, the measured inclination and measured azimuth, and the un-delayed inclination and azimuth values may be processed using an MPC scheme. The MPC scheme outputs inclination and azimuth errors/virtual control outputs which are in turn further processed at 134 to obtain one or more corrective steering tool settings which are depicted as a tool face error $U_{tf}$ in the embodiment shown on FIG. 6 (which is discussed in more detail below). The corrective steering tool setting(s) may then be applied at 136 to correct the direction of drilling.

Methods 100 and 120 may further advantageously include a feed forward step in which the measured borehole inclination and borehole azimuth values are processed to obtain feed forward inclination and azimuth errors/virtual control outputs which may be combined with the virtual control outputs from the MPC schemes 110 and 126 prior to the further processing at 112 and 128. The use of a feed forward loop advantageously accelerates convergence of the control methodology.

Figure 5:
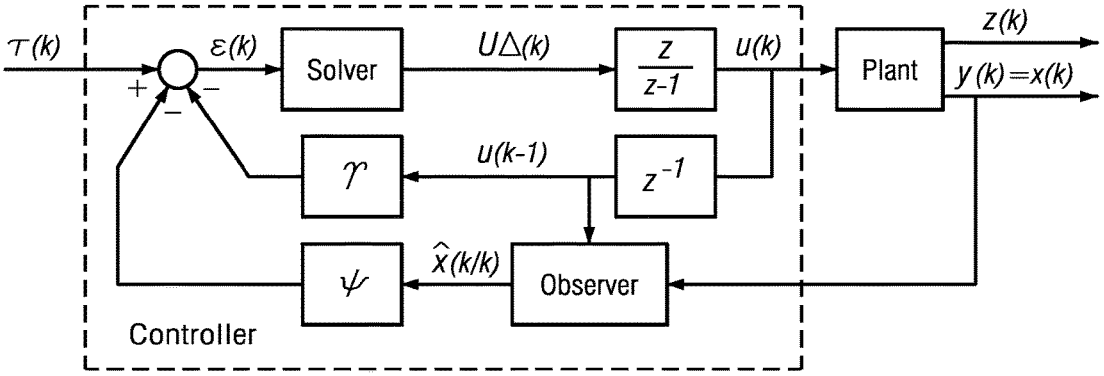
FIG. 5 depicts an unconstrained model predictive control architecture.
Figure 7:
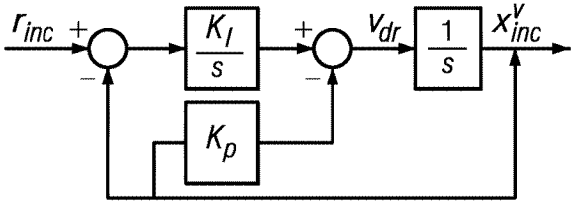
FIG. 7 depicts one example of a proportional integral feedback loop for obtaining drop and/or turn disturbances.
Figure 6:
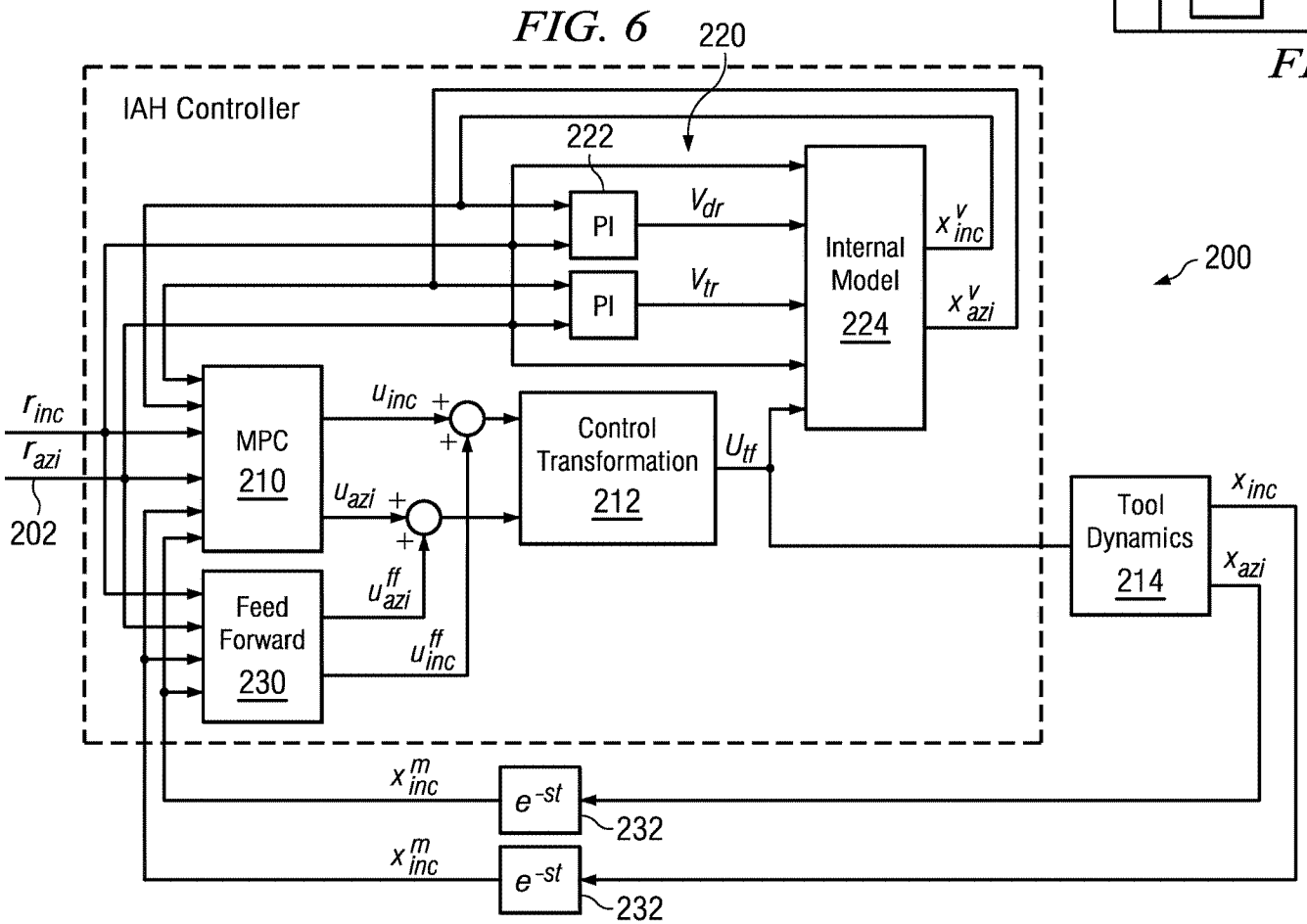
FIG. 6 depicts one example embodiment of closed loop inclination azimuth hold model predictive control architecture.

With reference now to FIGS. 5-7, the disclosed method and system embodiments make use of a model predictive control (MPC) scheme incorporating a state space plant model of a directional drilling tool (or BHA) derived from kinematic considerations. The MPC scheme may be optionally augmented with pure delays on the state variables. Provided with an estimate of the temporal feedback delay and other plant model parameters the MPC scheme is able to mitigate for the effects of the feedback delay.

The plant model may be derived from kinematic considerations, for example, to provide the following governing equations:

$$\dot{\theta}_{inc} = V_{rop}(U_{dls}\cos U_{tf} - V_{dr}) \tag{1}$$

$$\dot{\theta}_{azi} = \frac{v_{rop}}{\sin\theta_{inc}}(U_{dls}\sin U_{tf} - V_{tr}) \tag{2}$$

where $\theta_{inc}$ and $\theta_{azi}$ represent the borehole inclination and borehole azimuth, $\dot{\theta}_{inc}$ and $\dot{\theta}_{azi}$ represent the first derivatives of the borehole inclination and borehole azimuth with respect to time, $V_{rop}$ represents the rate of penetration, $U_{dls}$ represents the dog leg severity (curvature), $U_{tf}$ represents the tool face angle control input, and $V_{dr}$ and $V_{tr}$ represent the drop and turn rate disturbances.

It will be understood that the plant model expressed in Equations 1 and 2 is purely kinematic and thus ignores higher order dynamics of the BHA. This tends to be a good assumption in directional drilling operations since higher order dynamics of the BHA are generally much faster and decay faster than the dominant first order dynamics of borehole propagation.

It will further be understood that many directional drilling/steering tools are configured to respond with a nominal maximum curvature response $K_{dls}$ when drilling. To generate a curvature of less than $K_{dls}$ the tool may be configured to drill in cycles (similar to the duty cycle in power electronics or pulse-width-modulation) in which the drilling time is quantized into regularly spaced intervals which are further proportioned into neutral and bias periods. In the neutral period the toolface error (or input) $U_{tf}$ is cycled at a constant rate such that the net trajectory response of the tool is approximately a tangent with zero net curvature, and in the bias phase the tool-face is held constant and the tool responds with a curvature equal to $K_{dls}$. Consequently the average curvature over one drilling cycle can, in principle, be varied anywhere between zero and $K_{dls}$. The ratio of the neutral to bias phase in the drilling cycle is commonly referred to as the percent steering ratio with the dogleg severity $U_{dls}$ being the product of the percent steering ratio and $K_{dls}$. Notwithstanding the above, the disclosed embodiments are not limited to use with any particular directional drilling/steering tool configuration nor to any particular mode of directional control provided by the tool.

The tool kinematics expressed in Equations 1 and 2 are non-linear with two state variables (azimuth and inclination) and one or two inputs (toolface or toolface and steering ratio). The azimuth response in Equation 2 is coupled to the inclination response by the sine of the inclination term in the denominator of the expression factoring the azimuth governing equation. Equations 1 and 2 may be linearized, for example, via removing the drop and turn disturbances as follows:

$$\dot{\theta}_{inc} = V_{rop}U_{dls}\cos U_{tf} \tag{3}$$

$$\dot{\theta}_{azi} = \frac{v_{rop}}{\sin\theta_{inc}}U_{dls}\sin U_{tf} \tag{4}$$

The following transformations may further be used:

$$U_{tf} = A\ \mathrm{TAN}\ 2(U_{azi}, U_{inc}) \tag{5}$$

$$U_{dls}K_{dls}\sqrt{(U_{\mathrm{azi}})^2+(U_{\mathrm{inc}})^2} \tag{6}$$

where $U_{inc}$ and $U_{azi}$ represent the errors between the demand and measured inclination and azimuth values and may therefore be thought of as representing virtual controls for the borehole inclination and azimuth. Substituting Equations 5 and 6 into Equations 3 and 4 gives the following partially linearized kinematic expressions:

$$\dot{\theta}_{inc} = V_{rop}K_{dls}U_{inc} \tag{7}$$

$$\dot{\theta}_{azi} = \frac{V_{rop}}{\sin\theta_{inc}}K_{dls}U_{azi} \tag{8}$$

These expressions may in turn be linearized about a discrete operating point $\hat{\theta}_{inc}$, $\hat{\theta}_{azi}$, for example, as follows:

$$\dot{x}_{inc=au_{inc}} \tag{9}$$

$$\dot{x}_{azi}=cx_{inc}+bu_{azi} \tag{10}$$

where $\dot{x}_{inc}$ and $\dot{x}_{azi}$ represent the linearized first derivatives of the borehole inclination and borehole azimuth with respect to time, $u_{inc}$ and $u_{azi}$ represent the inclination and azimuth errors, $a=V_{rop}K_{dls}$, $b=a\csc\hat{\theta}_{inc}$, and $c=-a\csc\hat{\theta}_{inc}\cot\hat{\theta}_{azi}$.

The state space model given in Equations 9 and 10 (and in augmented form below) may be used for a standard unconstrained MPC formulation. The state space model may be expressed, for example, as follows:

$$\dot{x}=Ax+Bu$$

$$y=Cx+Du$$

As used herein MPC involves assuming an analytical model for the plant (system) to be controlled. For a given demand state vector trajectory over time a sequence of predicted control inputs is solved recursively with respect to some criterion (e.g., deviation from the state vector trajectory for example). At each recursion the first control input (or inputs) in the predicted sequence is applied to the real physical plant being controlled (i.e., the directional drilling tool). Included in the formulation prior to solving for the control input sequence is feedback of the response from the real physical plant being controlled to account for uncertainty between the assumed analytical plant model and the real plant. Because of the recursive nature of the MPC scheme the algorithm is inherently digital in nature.

The increment in the optimal control input vector over the prediction window may be evaluated, for example, using the following expression:

$$\Delta u(k)_{opt} = \begin{bmatrix} S_Q\Theta \\ S_R \end{bmatrix} \backslash \begin{bmatrix} S_Q\varepsilon(k) \\ 0 \end{bmatrix} \tag{11}$$

where $\Theta$ represents a prediction matrix as a function of the state space matrices acting on the control input vector increments $\Delta u(k)$, $S_Q$ and $S_R$ represent covariance weighting matrices for the state and input vectors respectively, and $$\varepsilon(k)=\tau(k)-\psi x(k)-Tu(k-1) \tag{12}$$

FIG. 5 depicts an unconstrained MPC architecture in which an observer is included in the architecture for the dynamic matrix control disturbance estimation and rejections scheme (e.g., as in J. M. Maciejowski, '*Predictive Control with Constraints', Prentice Hall*, ISBN 978-0-2013-9823-6, p. 81). The assumed state space model is augmented with disturbance states and incorporated into a Luenburger observer and the subsequently observed disturbance states used to offset the reference trajectory path. In FIG. 5, $\tau(k)$ represents a vector of length equal to the prediction window having the required state trajectories (a reference path), $\psi$ and T represent prediction matrices that factor the feedback state vector responses x(k) and the previous control inputs vector u(k−1) and are functions of the assumed open loop state space model, and $\varepsilon(k)$ represents the predictive error. The predictive error is obtained by combining $\tau(k)$, $\psi$, and T as depicted and given in Equation 12 and is input into the solver which solves for $\Delta u(k)_{opt}$ using Equation 11.

Turning to FIG. 6, a known pure delay in the feedback measurement of the state variables may be compensated by incorporating the unconstrained MPC scheme depicted on FIG. 5 into the overall delay compensated scheme depicted on FIG. 6. In the architecture depicted on FIG. 6, the basic drilling tool model is augmented by two state equations derived from first order Padé delay approximations $1-s\lambda/1+s\lambda$, where $\lambda$ represents the respective delays in seconds. Hence the state space model given in Equations 9 and 10 may be augmented with the delayed states as follows:

$$\dot{x}_{inc}^{v}=au_{inc} \tag{13}$$

$$\dot{x}_{inc}^{m}=[x_{inc}^{v}-x_{inc}^{m}-\lambda au_{inc}]/\lambda \tag{15}$$

where $x_{inc}^{v}$ and $x_{azi}^{v}$ represent the un-delayed states and $x_{inc}^{m}$ and $x_{azi}^{m}$ represent the physically measured and delayed states.

It will be appreciated that downhole rate of penetration measurements may be utilized to obtain the feedback delay $\lambda$. For example, the known (and fixed) distance between the bit and sensors may be divided by the measured rate of penetration to obtain the feedback delay $\lambda$. The disclosed embodiments are of course not limited in this regard as the feedback delay may be obtained via a rate of penetration estimation or other estimation techniques.

In Equations 9 and 10 the drop and turn disturbances $V_{dr}$ and $V_{tr}$ were removed. These disturbances may be added back in, for example, as given below:

$$\dot{x}_{inc}=au_{inc}+V_{dr} \tag{17}$$

$$\dot{x}_{azi}=cx_{inc}+bu_{azi}+V_{tr} \tag{18}$$

The drop and turn disturbances tend not to be directly measurable, but may be identified, for example, as follows. The drop and turn disturbances may be assumed to vary slowly relative to the attitude response of the drilling tool and may therefore be treated as being constant disturbance terms added to the internal model state equations (e.g., as given above in Equations 17 and 18). Second, it may be assumed that the core MPC scheme based on the state equations given in Equations 13-16 eliminates the limit cycles caused by the delayed feedback measurements but on its own does not compensate for the disturbances resulting in linear ramp responses with gradients equal to the drop and turn disturbances. As such a disturbance identification scheme may be based on a pair of PI feedback loops added to the inclination azimuth hold MPC scheme depicted on FIG. 6. The control output from these two PI feedback loops may then be used as the drop and turn disturbance terms in the internal model. The architecture for the disturbance identification feedback loops are discussed in more detail below with respect to FIG. 7.

The scheme 200 depicted on FIG. 6 may be thought of as incorporating three distinct (yet interrelated) modules, an MPC module 210 (e.g., Equations 13-16), a drop and turn disturbance module 220, and a feed forward module 230. The MPC module 210 receives the demand inclination and azimuth values $r_{inc}$ and $r_{azi}$ 202 (the values to be achieved), the measured inclination and azimuth values $x_{inc}^{m}$ and $x_{azi}^{m}$, and the un-delayed states $x_{inc}^{v}$ and $x_{azi}^{v}$ from the drop and turn disturbances module 220. The MPC module 210 outputs inclination and azimuth errors $u_{inc}^{ff}$ and $u_{azi}^{ff}$ (the virtual control outputs) which are in turn summed with the outputs $u_{inc}^{ff}$ and $u_{azi}^{ff}$ from the feed forward module 230 and input into a control transformation at 212. The control transformation outputs $U_{tf}$ to internal model 224 (e.g., Equations 17 and 18) and the real tool dynamics 214. The real tool dynamics 214 respond to $U_{tf}$ to change the direction of drilling to a new borehole inclination and borehole azimuth $x_{inc}$ and $x_{azi}$ (which define the drilling direction). The drilling direction is then measured (after a feedback delay which is depicted schematically at 232) with the measured values $x_{inc}^{m}$ and $x_{azi}^{m}$ being input into the MPC module 210 and the feed forward module 230. Meanwhile the internal model 224 outputs the un-delayed states $x_{inc}^{v}$ and $x_{azi}^{v}$ through corresponding PI loops 222 to estimate the drop and turn disturbances $V_{dr}$ and $V_{tr}$ which are fed back into the internal model 224.

The drop and turn disturbance feedback loops are depicted in further detail on FIG. 7. The demand inclination and azimuth values $r_{inc}$ and $r_{azi}$ are processed to obtain the un-delayed states $x_{inc}^{v}$ and $x_{azi}^{v}$. The gains for these PI loops are configured using pole placement derived expressions $K_I=\omega_n^2$ and $K_P=2\zeta\omega_n$ given a performance specification closed loop natural frequency $\omega_n$ and a damping ratio $\zeta$. Gain scheduling for the specification closed loop natural frequency $co_n$ as a function of demand $r_{inc}$ such that $V_{dr}$ may be set to zero when $r_{inc}$ is less than 10 degrees or greater than 170 degrees (i.e., when the borehole is near vertical). Alternative gain scheduling strategies may of course be utilized.

In the feed forward module 230 the inclination and azimuth error derivatives $d(r_{inc}-x_{inc})/dt$ and $d(r_{azi}-x_{azi})/dt$ are evaluated with dt being the update interval and Equations 7 and 8 being inverted to obtain $u_{inc}^{ff}$ and $u_{azi}^{ff}$. The demand feed forward Inc az is intended to speed up the attitude response of the method and improve attitude tracking at low inclination.

The disclosed embodiments are now described in further detail with respect to the following non-limiting examples. An inclination azimuth hold MPC scheme in accordance with the foregoing embodiments was simulated to evaluate the effectiveness of the methodology. In a first example, the simulation involved horizontal drilling with a small change to the drilling attitude. Table 1 displays the transient simulation parameters used in the example.

TABLE 1

Simulation Parameters

| Parameter | Value |
|---|---|
| Controller/Measurement Update Rate | 0.1 Hz (10 second) |
| Nominal Maximum Curvature $K_{dls}$ | 5 degrees per 100 feet |
| Rate of Penetration $V_{rop}$ | 100 feet per hour |
| Feedback Spatial Offset | 14 feet |
| Drop Disturbance $V_{dr}$ | 0.5 degrees per 100 feet |
| Turn Disturbance $V_{tr}$ | 0.25 degrees per 100 feet |
| MPC Prediction Window | 100 updates |
| MPC Control Window | 5 updates |
| MPC Q State Covariance | $1.0 \times 10^{6}$ |
| MPC R Input Covariance | $1.0 \times 10^{-5}$ |

Figure 8A:
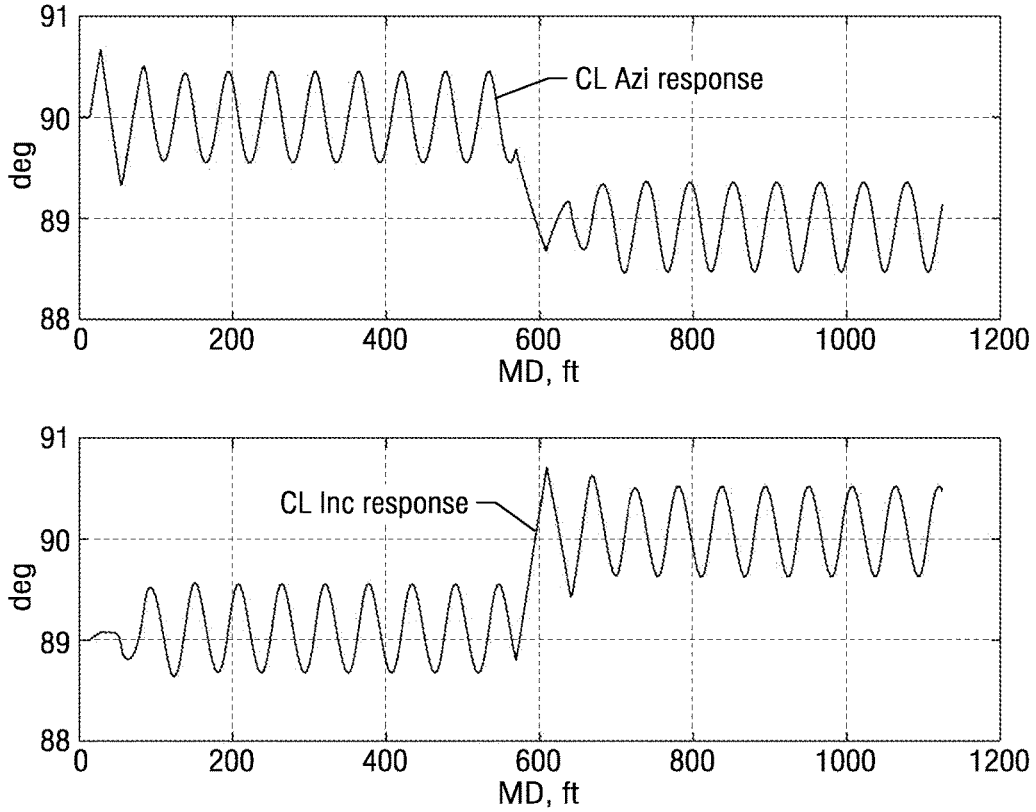
FIGS. 8A and 8B depict plots of simulated inclination and azimuth response as a function of measured depth for a control scheme (FIG. 8A) and a closed loop MPC scheme in accordance with the disclosed embodiments (FIG. 8B).
Figure 8B:
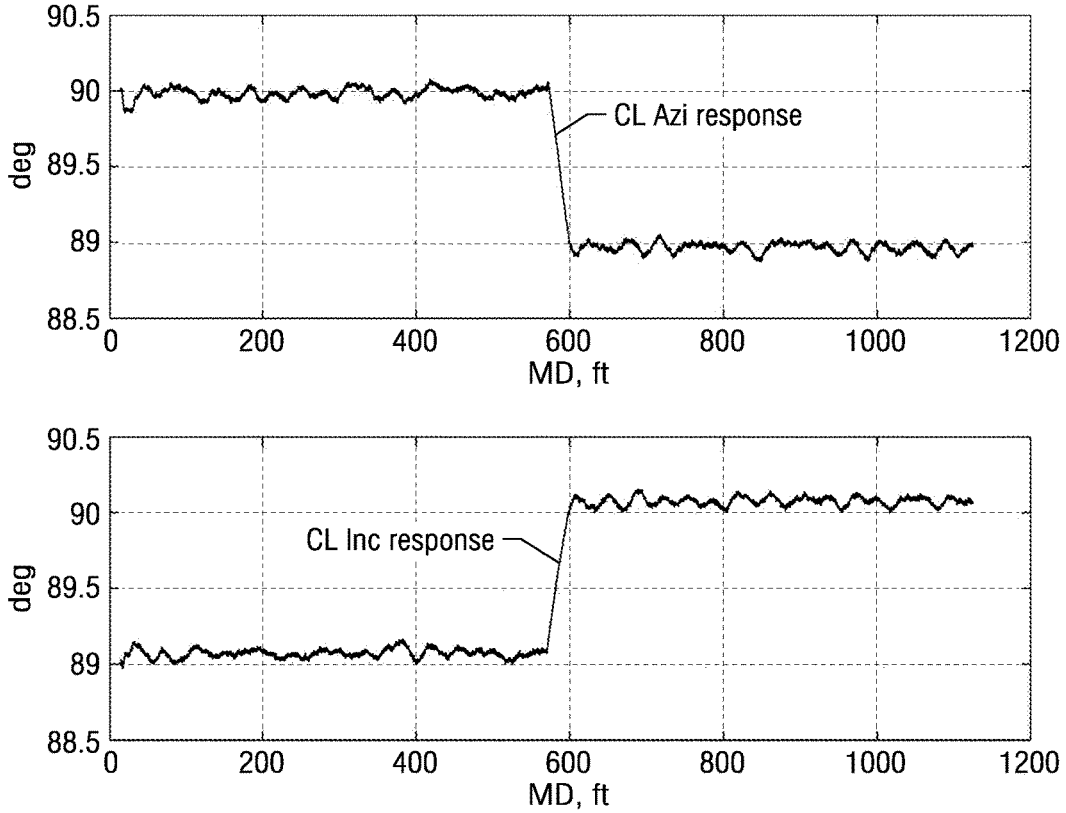

FIGS. 8A and 8B depict plots of simulated inclination and azimuth response as a function of measured depth for a comparative scheme (FIG. 8A) and a closed loop MPC scheme in accordance with the disclosed embodiments (FIG. 8B). The comparative simulation depicted on FIG. 8A utilizes a virtual tool face attitude hold algorithm previously disclosed by Panchal et al (*Attitude Control System for Directional Drilling Bottom Hole Assemblies, IET Proceedings Control Theory and Applications,* 6, 884-892, 2012) that does not compensate for the feedback delay. The simulation depicted on FIG. 8B makes use of the feedback delay compensated MPC scheme described above with respect to Equations 13-18. In both simulations the attitude was initially held at an inclination of 89 degrees and an azimuth of 90 degrees. At a measured depth of about 580 feet the attitude was adjusted such that the inclination was about 90 degrees and the azimuth was about 89 degrees.

A comparison of FIGS. 8A and 8B shows that the disclosed MPC scheme nearly eliminates the attitude limit cycle caused by the feedback measurement delay. For example, in FIG. 8A the closed loop response is oscillatory with an amplitude of about plus or minus 0.5 degrees about the target attitude (inclination and azimuth). FIG. 8B demonstrates that use of an MPC scheme augmented for feedback delay essentially eliminates such oscillations. Moreover, the MPC scheme shows a rapid response to the attitude adjustment at a measured depth of 580 feet.

Figure 9A:
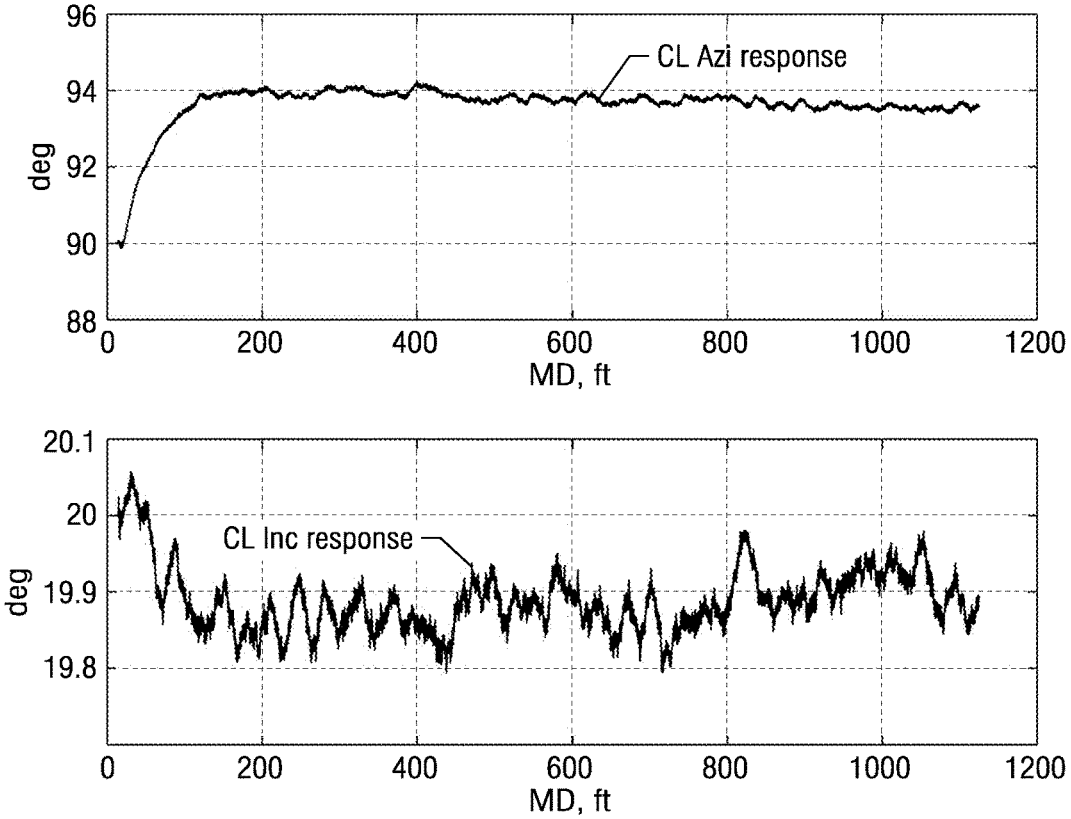
FIGS. 9A and 9B depict plots of simulated inclination and azimuth response as a function of measured depth for a closed loop MPC scheme without feed forward (FIG. 9A) and with feed forward (FIG. 9B).
Figure 9B:
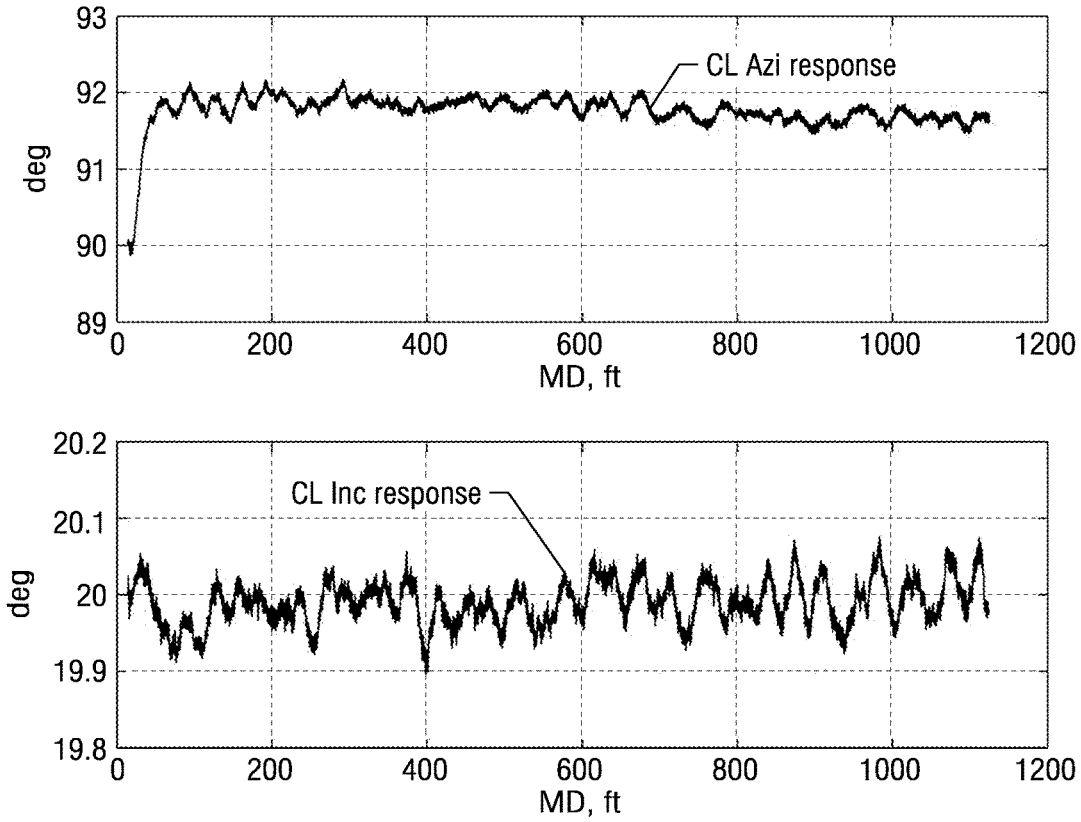

FIGS. 9A and 9B depict plots of simulated inclination and azimuth response as a function of measured depth for a closed loop MPC scheme without feed forward (FIG. 9A) and with feed forward (FIG. 9B). As clearly depicted, the use of feed forward improves both the speed of the response and the tracking with the steady state error for both inclination and azimuth being halved (as compared to the example without feed forward).

Figure 10A:
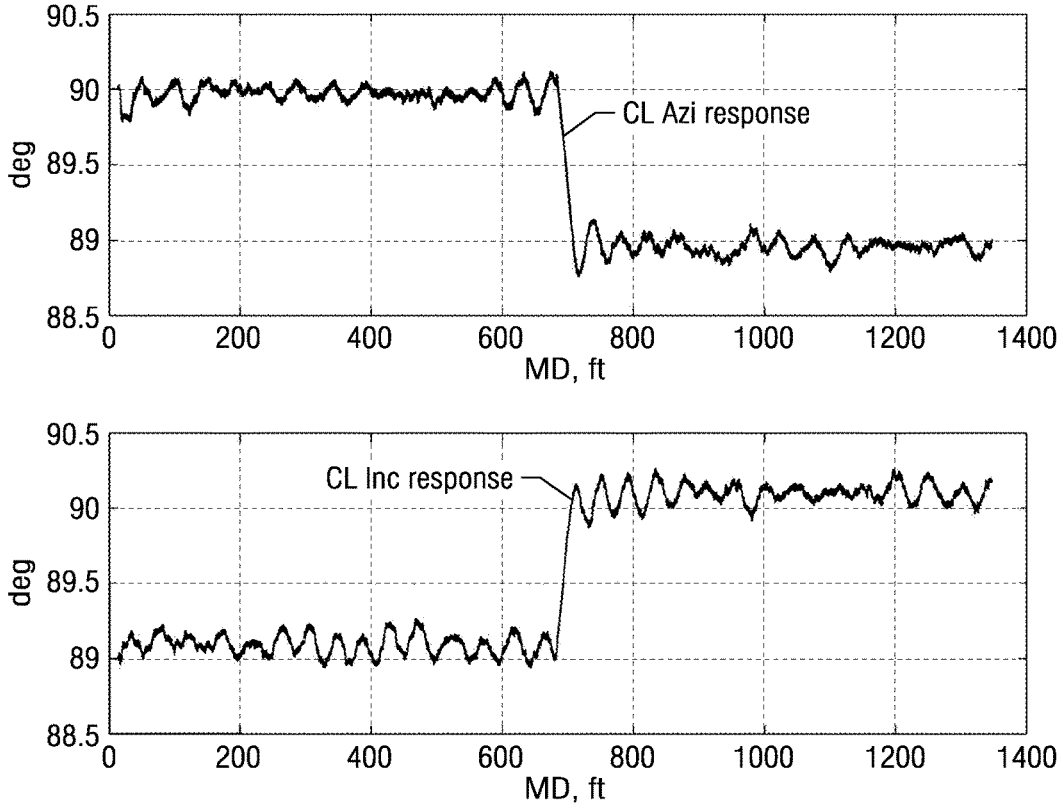
FIGS. 10A and 10B depict plots of simulated inclination and azimuth using the closed loop MPC scheme used in FIG. 8B plus a 20 percent uncertainty in the rate of penetration and the nominal maximum curvature (FIG. 10A) and minus a 20 percent uncertainty in the rate of penetration and the nominal maximum curvature (FIG. 10B).
Figure 10B:
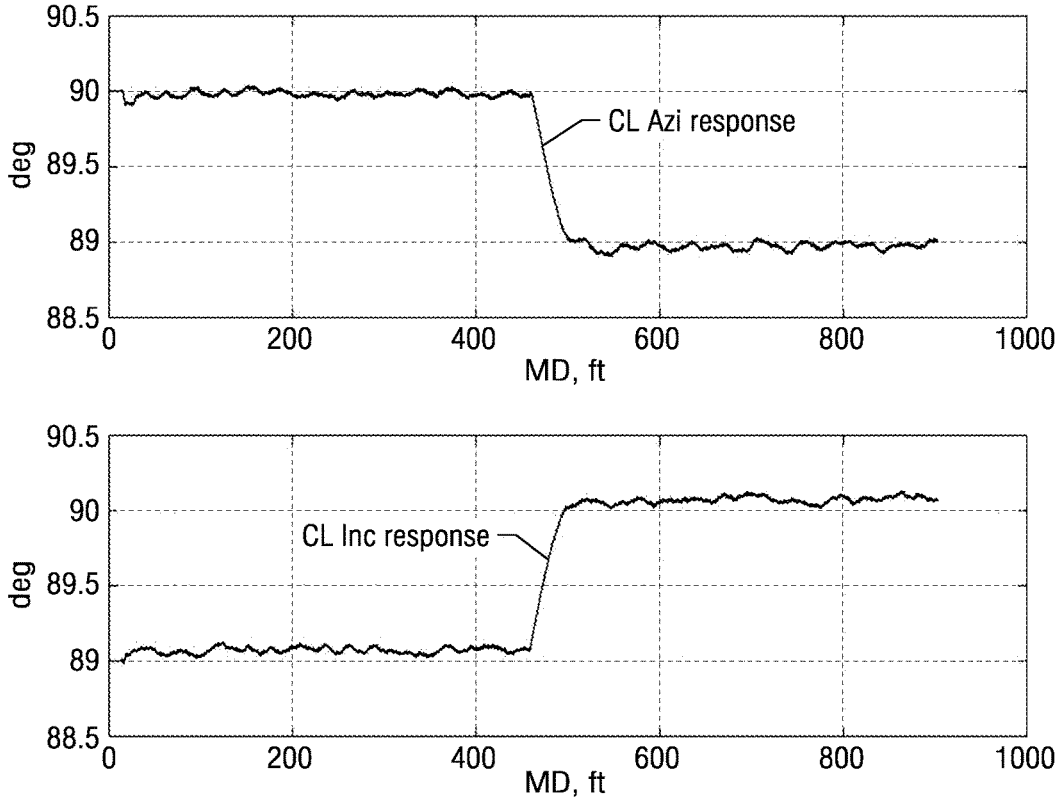

FIGS. 10A and 10B depict plots of inclination and azimuth response as a function of measured depth at inclination and azimuth values equal those shown in FIGS. 8A and 8B. These examples are intended to demonstrate the robustness of the disclosed MPC scheme via simulation. FIGS. 10A and 10B depict plots of simulated inclination and azimuth using the closed loop MPC scheme used in FIG. 8B plus a 20 percent uncertainty in the rate of penetration and the nominal maximum curvature (FIG. 10A) and minus a 20 percent uncertainty in the rate of penetration and the nominal maximum curvature (FIG. 10B). Note that even with the included uncertainties the closed loop MPC scheme is superior to that of the comparative algorithm in FIG. 8A. Note also that in these simulations underestimating the time delay (FIG. 10B) does not seem degrade the performance of the MPC algorithm.

The methods described herein are configured for downhole implementation via one or more controllers deployed downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above with respect to FIGS. 3 and 4 as well as Equations 1-18. A suitable controller may also optionally include other controllable components, such as sensors (e.g., a depth sensor), data storage devices, power supplies, timers, and the like. The controller may also be disposed to be in electronic communication with the attitude sensors (e.g., to receive the inclination and azimuth measurements). A suitable controller may also optionally communicate with other instruments in the drill string, such as, for example, telemetry systems that communicate with the surface. A typical controller may further optionally include volatile or non-volatile memory or a data storage device.

It will be understood that the closed loop MPC scheme disclosed herein may be used as a stand-alone control scheme (e.g., in an inclination attitude hold application) or as a module in a cascaded control loop scheme (e.g., in a geosteering application). The disclosed embodiments are not limited in these regards.

Although closed loop model predictive control of directional drilling attitude and certain advantages thereof have been described in detail, it should be understood that various changes, substitutions and alterations may be made herein without departing from the spirit and scope of the disclosure as defined by the appended claims.

What is claimed is:

1. A closed loop method for controlling a drilling attitude of a subterranean borehole, the drilling attitude defined by at least one of a borehole inclination and a borehole azimuth, the method comprising:

(a) deploying a drill string in a subterranean borehole, the drill string including a drill bit and a directional drilling tool deployed thereon;

(b) rotating the directional drilling tool and the drill bit to drill the subterranean borehole;

(c) receiving a demand state vector trajectory for subsequent drilling at a downhole controller located in the drill string;

(d) receiving a measured attitude at the downhole controller while drilling in (b);

(e) causing the downhole controller to process the demand state vector trajectory and the measured attitude using a model predictive control plant model to compute a sequence of predicted attitude errors that minimize deviation from the demand state vector trajectory received in (c); the plant model relating a first derivative of the drilling attitude with respect to time to (i) a rate of penetration of drilling in (b), (ii) a maximum theoretical dogleg of the directional drilling tool, (iii) the measured attitude, and (iv) an attitude error;

(f) causing the downhole controller to further process a first attitude error in the sequence of predicted attitude errors to obtain a corrective setting for a directional drilling tool; and (g) applying the corrective setting to the directional drilling tool while drilling in (b) to change the drilling attitude of the subterranean borehole.

2. The method of claim 1, wherein the drilling attitude is defined by a borehole inclination and a borehole azimuth;

the demand state vector trajectory includes demand inclination and demand azimuth values;

the measured attitude includes a measured inclination and a measured azimuth; and the first attitude error includes an inclination error and an azimuth error.

3. The method of claim 1, further comprising:

(h) continuously repeating (d), (e), (f), and (g) while drilling in (b).

4. The method of claim 1, wherein the plant model comprises the following mathematical equations:

$$\dot{x}_{inc}=au_{inc}$$

$$\dot{x}_{azi}=cx_{inc}+bu_{azi}$$

wherein $\dot{x}_{inc}$ and $\dot{x}_{azi}$ represent linearized first derivatives of borehole inclination and borehole azimuth with respect to time, $u_{inc}$ and $u_{azi}$ represent inclination and azimuth errors, $a=V_{rop}K_{dls}$, $b=a\operatorname{csc}\hat{\theta}_{inc}$, and $c=-a\operatorname{csc}\hat{\theta}_{inc}\cot\hat{\theta}_{azi}$, $V_{rop}$ represents a rate of penetration of drilling, $K_{dls}$ represents a nominal maximum curvature response of the directional drilling tool, and $\hat{\theta}_{inc}$ and $\hat{\theta}_{azi}$ represent measured inclination and azimuth values while drilling in (b).

5. The method of claim 1, wherein the predicted attitude errors are computed using the following mathematical equation:

$$\varepsilon(k)=\tau(k)-\psi x(k)-Tu(k-1)$$

wherein $\varepsilon(k)$ represents the predicted attitude errors, $\tau(k)$ represents a vector comprising the demand state vector trajectory, $\psi$ and $T$ represent prediction matrices, $x(k)$ represents the measured attitudes, and $\mu(k\text{-}1)$ represents previous control inputs.

6. The method of claim 1, wherein the plant model is augmented with linear delay approximations such that the plant model relates a first derivative of an un-delayed drilling attitude with respect to time to a rate of penetration of drilling in (b), a maximum theoretical dogleg of the directional drilling tool, the measured attitude, and an attitude error and the plant model further relates a first derivative of a delayed attitude to the un-delated drilling attitude, the measured attitude, and a delay.

7. The method of claim 6, wherein the plant model comprises the following mathematical equations:

$$\dot{x}_{inc}{}^{v}=au_{inc}$$

$$\dot{x}_{inc}{}^{m}=[x_{inc}{}^{v}-x_{inc}{}^{m}-\lambda au_{inc}]/\lambda$$

wherein $x_{inc}{}^{v}$ and $x_{azi}{}^{v}$ represent un-delayed inclination and azimuth values, $x_{inc}{}^{m}$ and $x_{azi}{}^{m}$ represent measured inclination and measured azimuth values received in (d), $\lambda$ represents delay, $u_{inc}$ and $u_{azi}$ represent inclination and azimuth errors, $a=V_{rop}K_{dls}$, $b=a\operatorname{csc}\hat{\theta}_{inc}$, and $c=-a\operatorname{csc}\hat{\theta}_{inc}\cot\hat{\theta}_{azi}$, $V_{rop}$ represents a rate of penetration of drilling, $K_{dls}$ represents a nominal maximum curvature response of the directional drilling tool, and $\hat{\theta}_{inc}$ and $\hat{\theta}_{azi}$ represent measured inclination and azimuth values while drilling in (b).

8. The method of claim 1, further comprising:

(h) processing the demand attitude using a proportional integral loop to obtain an attitude disturbance;

(i) processing the attitude disturbance and the demand attitude to obtain an un-delayed attitude; and wherein (e) comprises processing the demand state vector trajectory, the measured attitude, and the un-delayed attitude using the model predictive control plant model to obtain the attitude error, wherein the plant model further relates a first derivative of a delayed attitude to the un-delayed drilling attitude, the measured attitude, and a delay.

9. The method of claim 1, further comprising:

(h) processing the measured attitude with the attitude error obtained in (e) to obtain a combined attitude error; and where (f) comprises processing the combined attitude error obtained in (i) to obtain the corrective setting for the directional drilling tool.

10. A closed loop method for controlling a drilling attitude of a subterranean borehole, the drilling attitude defined by a borehole inclination and a borehole azimuth, the method comprising:

(a) deploying a drill string in a subterranean borehole, the drill string including a drill bit and a directional drilling tool deployed thereon;

(b) rotating the directional drilling tool and the drill bit to drill the subterranean borehole;

(c) receiving a demand inclination and a demand azimuth for subsequent drilling at a downhole controller located in the drill string;

(d) receiving a measured attitude at the downhole controller while drilling in (b), the measured attitude including a measured inclination and a measured azimuth;

(e) causing the downhole controller to process the demand inclination and the demand azimuth received in (c) using corresponding proportional integral loops to obtain corresponding drop and turn disturbances;

(f) causing the downhole controller to process the drop and turn disturbances obtained in (e) and the demand inclination and the demand azimuth received in (c) to obtain an un-delayed inclination and an un-delated azimuth;

(g) causing the downhole controller to process the demand inclination, the demand azimuth, the measured inclination, the measured azimuth, the un-delayed inclination, and the un-delayed azimuth using a model predictive control plant model to compute a sequence of predicted inclination and azimuth errors that minimize deviation from a demand state vector trajectory received: the plant model relating a first derivative of an un-delayed drilling attitude with respect to time to a rate of penetration of drilling in (b), a maximum theoretical dogleg of the directional drilling tool the measured attitude, and an attitude error: and the plant model further relating a first derivative of a delayed attitude to the un-delated drilling attitude, the measured attitude, and a delay;

(h) causing the downhole controller to process a first inclination error and a first azimuth error in the sequence of predicted inclination and azimuth errors to obtain a corrective setting for the directional drilling tool; and (i) applying the corrective setting to the directional drilling tool while drilling in (b) to change the drilling attitude of the subterranean borehole.

11. The method of claim 10, further comprising:

(g) continuously repeating (d), (e), (f), (g), (h), and (i) while drilling (b).

12. The method of claim 10, wherein the plant model comprises the following mathematical equations:

$$\dot{x}_{inc}=au_{inc}+V_{dr}$$

$$\dot{x}_{azi}=cx_{inc}+bu_{azi}+V_{tr}$$

wherein $\dot{x}_{inc}$ and $\dot{x}_{azi}$ represent linearized first derivatives of the borehole inclination and borehole azimuth with respect to time, $u_{inc}$ and $u_{azi}$ represent inclination and azimuth errors, $V_{dr}$ and $V_{tr}$ represent the drop and turn disturbances, $a=V_{rop}-K_{dls}$, $b=a\csc\hat{\theta}_{inc}$, and $c=-a\csc\hat{\theta}_{inc}\cot\hat{\theta}_{azi}$, $V_{rop}$ represents a rate of penetration of drilling, $K_{dls}$ represents a nominal maximum curvature response of the directional drilling tool, and $\hat{\theta}_{inc}$ and $\hat{\theta}_{azi}$ represent measured inclination and azimuth values while drilling in (b).

13. The method of claim 10, wherein the plant model comprises the following mathematical equations:

$$\dot{x}_{inc}^{m}=[x_{inc}^{v}-x_{inc}^{m}-\lambda au_{inc}]/\lambda$$

wherein $x_{inc}^{v}$ and $x_{azi}^{v}$ represent un-delayed inclination and azimuth values, $x_{inc}^{m}$ and $x_{azi}^{m}$ represent the measured inclination and the measured azimuth received in (d), $\lambda$ represents delay, $u_{inc}$ and $u_{azi}$ represent inclination and azimuth errors, $a=V_{rop}K_{dls}$, $b=a\csc\hat{\theta}_{inc}$, and $c=-a\csc\hat{\theta}_{inc}\cot\hat{\theta}_{azi}$, $V_{rop}$ represents a rate of penetration of drilling, $K_{dls}$ represents a nominal maximum curvature response of the directional drilling tool, and $\hat{\theta}_{inc}$ and $\hat{\theta}_{azi}$ represent measured inclination and azimuth values while drilling in (b).

14. The method of claim 10, further comprising:

(j) processing the demand inclination and the demand attitude received in (c) and the measured attitude received in (d) to obtain a feed forward inclination and a feed forward azimuth;

(k) combining the feed forward inclination and the feed forward azimuth with the first inclination error and the first azimuth error in the sequence of predicted inclination and azimuth errors to obtain a combined inclination error and a combined azimuth error; and wherein (h) comprises processing the combined inclination error and the combined azimuth error obtained in (k) to obtain a corrective setting for the directional drilling tool.

15. A bottom hole assembly comprising:

a directional drilling tool configured for coupling with a drill string and controlling a drilling attitude of a subterranean borehole;

at least one sensor configured to measure an inclination and an azimuth of a subterranean borehole; and a controller configured to (i) process a demand inclination, a demand azimuth, a measured inclination, and a measured azimuth using a model predictive control plant model to compute a sequence of predicted attitude errors that minimize deviation from a state vector trajectory; the plant model relating a first derivative of the drilling attitude with respect to time to a rate of penetration of drilling, a maximum theoretical dogleg of the directional drilling tool, the measured inclination and measured azimuth, and an inclination error and an azimuth error to obtain an inclination error and an azimuth error, (ii) process the inclination error and the azimuth error to obtain a corrective setting for the directional drilling tool,. and (iii) apply the corrective setting to the direction drilling tool to change a direction of drilling.

16. The assembly of claim 15, wherein the controller is configured to (i) process the demand inclination and the demand azimuth using corresponding proportional integral loops to obtain corresponding drop and turn disturbances, (ii) process the drop and turn disturbances and the demand inclination and the demand azimuth to obtain an un-delayed azimuth using a model predictive control plant model to obtain an inclination error and an azimuth error, (iv) process the inclination error and the azimuth error to obtain a corrective setting for the direction drilling tool, and (v) apply the corrective setting to the directional drilling tool to change a direction of drilling.

* * * * *